United States Patent [19]

Baggio et al.

[11] Patent Number: 4,916,834

[45] Date of Patent: Apr. 17, 1990

[54] HEEL SECURING DEVICE PARTICULARLY FOR SKI BOOTS

[75] Inventors: Giorgio Baggio, San Martino Di Lupari; Giuseppe De Bortoli, Montebelluna, both of Italy

[73] Assignee: Nordica S.p.A., Montebelluna TV, Italy

[21] Appl. No.: 284,567

[22] Filed: Dec. 14, 1988

[30] Foreign Application Priority Data

Dec. 22, 1987 [IT] Italy ..... 82624 A/87

[51] Int. Cl.[4] ..... A43B 5/04; A43B 23/28

[52] U.S. Cl. ..... 36/117; 36/58.6; 36/119; 36/120

[58] Field of Search ..... 36/117–121, 36/58.5, 58.6, 89, 92, 105

[56] References Cited

U.S. PATENT DOCUMENTS

| | | | |
|---|---|---|---|
| 4,724,625 | 2/1988 | Sartor | 36/117 |
| 4,823,484 | 4/1989 | Couty | 36/117 |

FOREIGN PATENT DOCUMENTS

| | | | |
|---|---|---|---|
| 0258824 | 3/1988 | European Pat. Off. | 36/117 |
| 2522968 | 1/1977 | Fed. Rep. of Germany | 36/117 |
| 3808652 | 11/1988 | Fed. Rep. of Germany | 36/117 |

*Primary Examiner*—James Kee Chi

*Attorney, Agent, or Firm*—Modiano Guido; Albert Josif

[57] ABSTRACT

The heel securing device is for use in rear entry ski boots having a shell, a front quarter associated with the shell and defining anterior lateral portions including one anterior lateral portion and an opposite anterior lateral portion, and a rear quarter articulated to the shell and defining a rear lateral portion and a heel region. The heel securing device has an elongate element having one end connected to one lateral portion selected from among the anterior lateral portion and the rear lateral portion, an intermediate portion extending around the heel region of the rear quarter, and another end connected to the opposite anterior lateral portion of the front quarter.

16 Claims, 2 Drawing Sheets

HEEL SECURING DEVICE PARTICULARLY FOR SKI BOOTS

BACKGROUND OF THE INVENTION

The present invention relates to a heel securing device, particularly for rear-entry ski boots.

It is currently known that a problem to be solved in the manufacture of ski boots, in particular rear-entry ski boots, is that of correctly securing the skier's heel.

However, due to the particular structure of such boots, the ankle is necessarily allowed a certain play within the shell. This play limits the skier's sensitivity when transmitting to the ski the forces generated during the bending and stretching movements occurring during skiing.

As a partial solution to these disadvantages, U.S. Pat. No. 4,615,127, is known wherein a screw mounted on the rear quarter is adapted to cause plates or rigid blocks to interact with a flap protruding from the heel region of the shell.

Such a solution, however, is not devoid of disadvantages: first of all the plates or blocks are rigid and therefore difficult to adapt to the anatomical morphology of the foot, and they furthermore act on a small region of the flap at the heel region of the shell, causing concentrated points of localized pressure.

Known from German patent No. 2732522 is a ski boot having rigid side panels rearwardly separated by a U-shaped notch, and a bridge piece having inwardly pointing extensions engageable in vertical holes formed in the boot adjacent the U-shaped notch, for detachably fixing the bridge piece thereon, so as to adapt the ankle portion of the boot to the anatomical morphology of a skier's ankle.

However, while such an arrangement may be satisfactory for adjusting the fit of the upper cuff of a boot at the ankle region, it has the disadvantage that it does not permit the wearer's heel to be secured within the boot since it does not act on the heel region. Furthermore, tightening of the bridge piece contracts the ankle region of the boot. This can cause difficulty when putting on and taking off the boot, and may constitute a source of discomfort during skiing.

Known from U.S. Pat. No. 2,935,798 is a ski boot having a pair of rigid blades defining fore ends riveted to opposite external sides of the shell below the instep, and rear ends which are drawn together by a tightener above the ball of the heel with resultant deformation of the heel region of the boot shell.

While such an arrangement could be adopted with shells or uppers made of leather or similar flexible material, it would not be suitable in modern ski boot construction employing a rigid heel portion designed to protect the skier's heel, which could not readily transmit pressure from the tightened blades to the skier's foot. Furthermore, such blades located at the exterior of the shell can easily be damaged and may even constitute a safety hazard in the case of a fall since they may become entrapped or entangled and cause injury to the skier. Such blades are also extremely awkward to tighten while the boot is being worn, create difficulty regarding putting on the boot if tightened before being worn, and lead to damage of the shell through the deformation necessarily caused when tightened.

As a partial solution to such problems, U.S. Pat. No. 4,160,332 teaches a ski boot having a shell surrounding the foot and the front of the tibia, a rear spoiler hinged to the shell, and a device for applying pressure to the instep through a distributor plate which is actuated by closing the spoiler onto the shell. Although such an arrangement has proved to be effective for securing the instep portion or fore-part of the foot within the boot, it does not solve the problem of how to prevent a skier's heel from shifting when performing forward stretching movements during skiing.

Thus, such known types of ski boot do not permit maximum sensibility in transmission of the skier's movements to the ski to be maintained at all times. Frequently, skiers possessing such known types of boots often make resort to excessively tightening instep pressers to force the heel towards the lower heel region of the boot, but even such excessive tightening does not always prevent the heel from shifting upwardly when stretching forwards, and often causes discomfort due to the excessive pressure exerted on the foot in such an attempt to secure the heel.

As a partial solution to these disadvantages, U.S. Pat. No. 4,724,625 of Feb. 16, 1988 by the same applicant discloses a ski boot particularly of the rear-entry type comprising an elongate element extending transversely to the longitudinal extension of the rear quarter of the ski boot, said elongate element being provided inside the rear quarter substantially at the heel of the user's foot and being connected to the opposite longitudinal edges of the rear quarter.

Though said elongate element allows uniform distribution of forces at the flap, it does not permit optimum securing of the skier's heel when stretching during skiing, since the degree of rotation of the rear quarter is less than the degree of rotation of the front quarter.

Should the skier wish to tighten the elongate element in order to compensate for this disadvantage when stretching during skiing, another disadvantage arises due to the difficulty encountered when inserting the foot into and extracting the foot from the boot, since the elongate element, when so-tightened, hinders backward movement of the flap protruding from the shell at the heel region.

SUMMARY OF THE INVENTION

Accordingly, the aim of the present invention is therefore to eliminate the disadvantages described above in known types of ski boots by providing a heel securing device, particularly for rear-entry ski boots, which permits optimum securing of the heel region of the foot, and wherein the degree of securing is increased during forward flexing of the skier's leg.

Within the above described aim, another important object of the invention is to provide a heel securing device which associates with the preceding characteristic that of allowing the skier's foot to be easily inserted into, and extracted from, the boot.

Another important object of the invention is to provide a heel securing device which allows the skier to preset and/or adjust the degree of securing of the heel according to his specific technical and/or anatomical requirements.

A further object of the invention is to provide a heel securing device which achieves an optimum degree of comfort in use, even when adjusted to prevent any undesired movement of the heel within a ski boot at all times, and which can automatically increase the securing pressure exerted on a skier's heel when greater forces are created such as when stretching forwards during skiing.

Yet another object of the invention is to provide a heel securing device which is extremely reliable and safe in use.

Not least object of the invention is to provide a heel securing device which is obtainable with means commonly available on the market and having very modest costs.

The above-mentioned aim and objects and others which will become apparent hereinafter are achieved by a heel securing device, particularly for ski boots having a front quarter and a rear quarter associated with a shell, said heel securing device comprising, at least one elongate element extending internally and transversely to the longitudinal extension of said rear quarter at a heel region thereof, characterized in that said elongate element has at least one end at least temporarily connected to at least one lateral portion of said ski boot selected from among an anterior lateral portion defined on the front quarter and a rear lateral portion defined on the rear quarter, and at least one other end at least temporarily connected to an opposite lateral portion of said rear quarter, means for adjusting the useful length of said elongate element being associated with said elongate element.

BRIEF DESCRIPTION OF THE DRAWINGS

Further characteristics and advantages of the invention will become apparent from the detailed description of two particular but not exclusive embodiments, illustrated only by way of non-limitative example in the accompanying drawings, wherein.

DESCRIPTION OF THE PREFERRED EMBODIMENTS

Figures 1, 2, 3, 4:
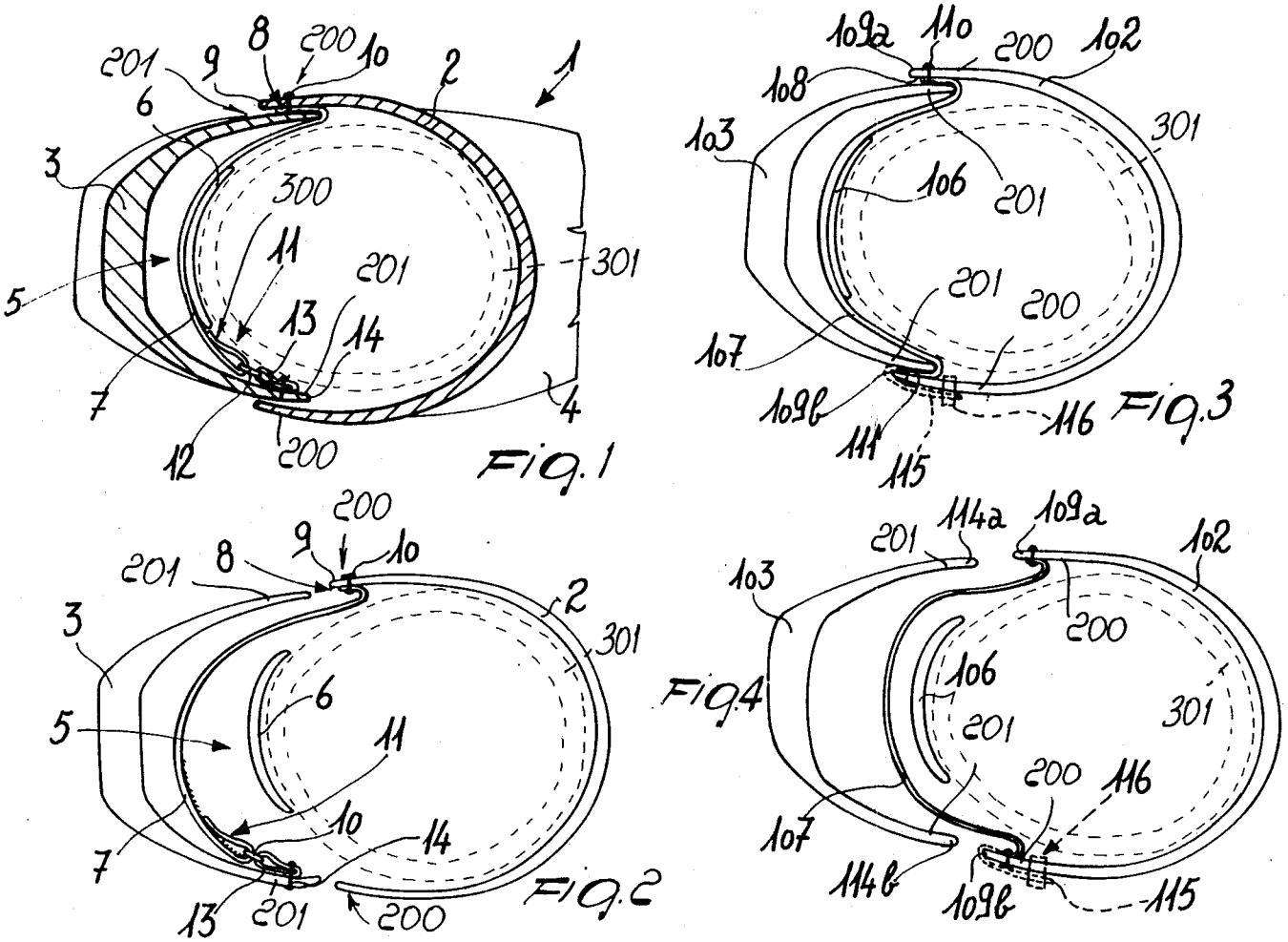
FIG. 1 is a partially sectional plan view of the heel securing device applied to a ski boot with the quarters closed.
FIG. 2 is a schematic plan view, of the heel securing device applied to a ski boot, wherein the quarters are open.
FIG. 3 is a schematic plan view, of a heel securing device, according to another aspect of the invention, applied to a boot wherein the quarters are closed.
FIG. 4 is a schematic plan view, of the heel securing device of FIG. 3, applied to a boot wherein the quarters are open.

With reference to the above described figures, the reference numeral 1 indicates a ski boot constituted by a front quarter 2 and by a rear quarter 3 associated with a shell 4.

Advantageously, a flap 6 which partially embraces the ankle of the skier may protrude from said shell at the heel region 5.

The heel securing device comprises an elongate element 7, preferably constituted by a band, which extends inside the boot 1 and transversely embraces the flap 6.

Said elongate element can be of the non-extendable type or have at least one elastic portion, preferably in its central region, to achieve a better adaptation to the anatomical configuration of the foot.

Said elongate element 7 has a first end 8 rigidly associated with the interior face of the front quarter 2, proximate to one of its rearwardly facing longitudinal edges 9 at an anterior lateral portion 200 thereof.

Said rigid association may occur e.g. by means of a mechanical fixing means such as a rivet 10, the elongate element 7 being then passed behind the flap 6.

A tear-apart strip 300, for example, of the type known by the Registered Trademark "Velcro", may be associated with the second end 11 of the elongate element 7 and constitutes a means for adjusting the useful length of said elongate element 7. Said second end is caused to pass at a ring 12 fixed, by means of a flap on tab 13, at an inner lateral surface of the rear quarter 3, defined at a rear lateral portion 201 thereof, adjacent to a longitudinal edge 14, located opposite the longitudinal edge 9 of said front quarter whereat the first end 11 of the elongate element 7 is attached.

The use of the device is as follows: starting from the condition illustrated in FIG. 2, with the quarters open, upon the approach of the rear quarter 3 to the front quarter 2 the longitudinal edge 9 of the rear quarter 3 interacts with the elongate element 7, determining the tensioning thereof.

This tensioning thus forces the correct location of the flap 6 located at the heel region 5, thereby securing the skier's heel in an optimum condition, which can be adjusted according to contingent requirements by selecting the useful length of the elongate element 7 as desired by simply locating the second end 11 of the elongate element 7 at any desired position on the tear-apart strip 300.

When the quarters are opened, the elongate element 7 is immediately and automatically released, thus allowing the immediate release of the heel, thereby allowing a skier, without any further actuation, to easily extract or insert the foot.

The fact is furthermore stressed that when stretching forward during skiing, causing forward flexing of the quarters, there occurs an increase in the pressure exerted on the skier's heel at the flap 6, said increase being advantageous for the correct securing of the heel at all times while skiing.

Naturally the invention is susceptible to numerous modifications and variations, all within the scope of the same inventive concept.

Thus, for example, the elongate element 7 can be caused to act directly onto an inner boot 301 at the heel region of the foot by omitting the flap 6.

According to another aspect of the invention, illustrated in FIGS. 3 and 4, the first end 108 of an elongate element 107, again constituted by a band, is rigidly associated with an anterior lateral portion 200 of the front quarter 102 by means of a rivet 110 or other mechanical fixing means located proximate to the first longitudinal edge 109*a* of said front quarter 102.

Said elongate element has a first portion extending rearwardly from the first longitudinal edge 109*a*, followed by a second portion which extends transversely across the heel region 5 of the rear quarter to embrace the flap 106 associated with the shell, and a further portion whereat the elongate element 107 extends towards a second longitudinal edge 109*b* of the rear quarter 103.

The second end 111 of the elongate element 107 is furthermore associable, in a fixed or slideable manner, with the inner surface of the front quarter 102 proximate to its second longitudinal edge 109*b*.

Thus, upon the approach of the rear quarter 103 towards the front quarter 102 the longitudinal edges 114*a* and 114*b* of the rear quarter therefore interact with the elongate element 107 and thus cause its tensioning at the flap 106.

The means for adjusting the useful length of the elongate element 107 may be constituted e.g. by a cable 115 connected to the second end 111 of the elongate element 107 which extends externally to the front quarter 2 and is caused to interact with a conventional cable tensioning means 116.

Tightening of said means 116, causes the second end 111 of the elongate element 107 to slide with respect to the inner lateral surface of the front quarter 102 adjacent to the second longitudinal edge 109*b*.

Thus the intended aim and objects have been achieved, a device having been provided which allows to achieve the optimum securing of the heel, which securing is increased during the forward flexing step of the skier's leg.

The simple opening of the quarters furthermore allows to cancel the pressure exerted at the flap or directly at the heel of the skier, allowing the latter to freely extract or insert the foot from or into the boot.

The possibility of adjusting the useful length of the elongate element furthermore allows each skier to preset the correct pressure to be exerted at the heel according to the anatomical characteristics of the foot.

Naturally the materials and the dimensions which constitute the individual components of the device may be selected according to the specific requirements.

For example, any type of mechanical adjuster may be incorporated for adjusting the useful working length of the elongate element instead of the tear-apart strip 300.

Figure 5:
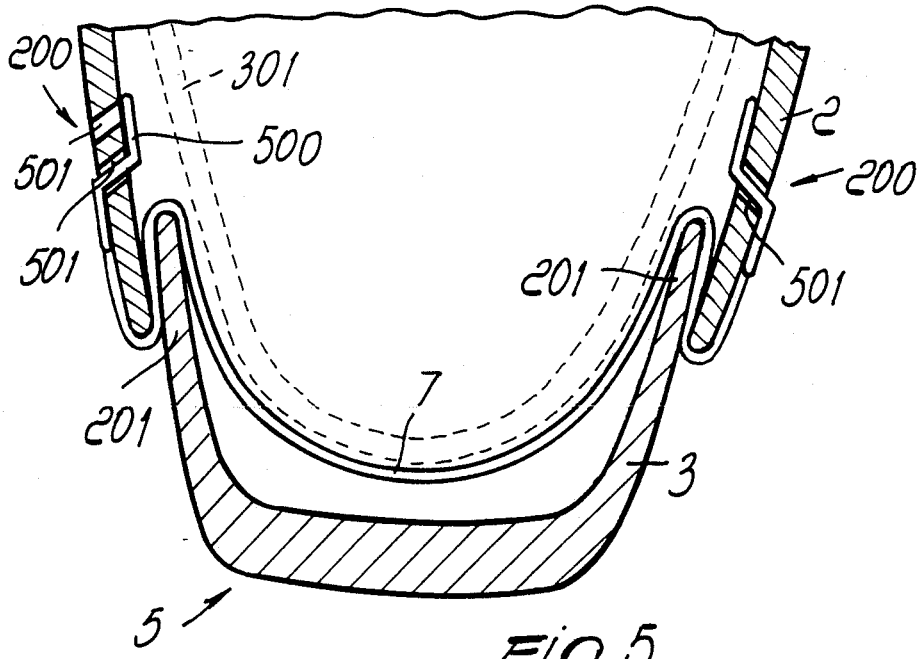
FIG. 5 is a partly sectional plan view of the heel securing device according to a further aspect of the invention.
Figure 6:
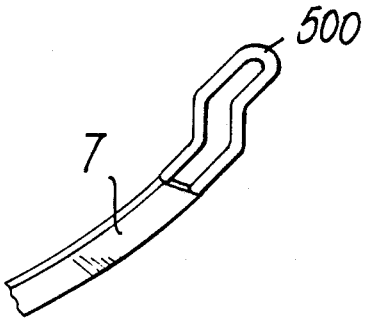
FIG. 6 is a fragmentary detail view of the heel securing device of FIG. 5.

Furthermore, as shown in FIGS. 5 and 6, the adjustment means may be constituted by hook-like members 500, having a substantially "Z"-like shape, located at the ends of the elongate element 7 which are each selectively engageable in one of a series of engagement holes 501 formed in the anterior lateral portions 200 of the front quarter 2.

Obviously the position and arrangement of such series of holes may be selected according to requirements. Thus, for instance, one end of the elongate element 7 may be connected to either the anterior lateral portion 200 of the front quarter 2 or to a rear lateral portion 201 of the rear quarter 3, while the other end of the elongate element 7 is connected to an opposite anterior lateral portion 200 of the front quarter 2.

We claim:

1. In combination, a ski boot and a heel securing device, said ski boot comprising:

a shell, a lateral surface defined on said shell, a front quarter associated with said shell, an anterior lateral portion defined on said front quarter, a rear quarter associated with said shell, a rear lateral portion defined on said rear quarter, an opposite lateral portion defined on said rear quarter, a longitudinal extension defined by said rear quarter, and a heel region defined in said rear quarter, said heel securing device comprising;

at least one elongate element, said elongate element extending internally and transversely to said longitudinal extension of said rear quarter at said heel region, at least one end defined by said elongate element, said end being at least temporarily connected to at least one lateral portion of said ski boot, said lateral portion of said ski boot being selected from among said anterior lateral portion defined on said front quarter, said lateral portion defined by said shell, and said rear lateral portion defined on said rear quarter, at least one other end defined by said elongate element, said other end being at least temporarily connected to said opposite lateral portion of said rear quarter, a useful length defined by said elongate element, and means for adjusting said useful length of said elongate element, said means being associated with said elongate element.

2. Combination according to claim 1, wherein said ski boot further comprises;

an inner shoe accommodated within said shell, and an inner shoe heel region defined by said inner shoe, and wherein said elongate element comprises at least one band, said band being selected from among; a non-extendable band, a band having elastically deformable portions and a non-extendable band having elastically deformable portions, said band embracing said inner shoe heel region.

3. Combination according to claim 1, wherein said ski boot further comprises;

a shell heel region defined in said shell, and a flap protruding from said shell heel region, and wherein said elongate element comprises at least one band, said band being selected from among; a non-extendable band, a band having elastically deformable portions and a non-extendable band having elastically deformable portions, said band embracing said flap.

4. Combination according to claim 1, wherein said elongate element comprises at least one band, said band being selected from among; a non-extendable band, a band having elastically deformable portions and a non-extendable band having elastically deformable portions, said band being adapted for directly embracing a skier's heel.

5. Combination according to claim 1, wherein said lateral surface defined on said shell is constituted by an inner lateral shell surface, and wherein said one end of said elongate element is rigidly associated with inner lateral shell surface.

6. Combination according to claim 1, wherein said anterior lateral portion defined on said front quarter is constituted by an inner lateral surface of said front quarter, and wherein said one end of said elongate element is rigidly associated with said inner lateral surface of said front quarter.

7. Combination according to claim 6, wherein said front quarter has a longitudinal edge, and wherein said one end of said elongate element is rigidly associated with said inner lateral surface of said front quarter proximate to said longitudinal edge.

8. Combination according to claim 3, wherein said elongate element extends from said one end towards said rear quarter then embraces said flap.

9. Combination according to claim 1, further comprising means for adjusting said useful length defined by said elongate element, wherein said rear quarter has a longitudinal edge, wherein said rear lateral portion defined on said rear quarter comprises an inner lateral surface of said rear quarter, and wherein said means for adjusting said useful length defined by said elongate element comprise;

at least one tab connected to said inner lateral surface of said rear quarter proximate to said longitudinal edge, at least one ring fixed to said tab, and at least one tear-apart strip connected to said other end of said elongate element and to said ring.

10. Combination according to claim 1, wherein said front quarter has a front longitudinal edge, wherein said anterior lateral portion defined on said front quarter comprises an inner lateral surface of said front quarter, and wherein said elongate element has an elongate element portion, said elongate element portion extending towards said rear quarter, said other end end being rigidly associated with said inner lateral surface of said front quarter proximate to said front longitudinal edge.

11. Combination according to claim 1, wherein said front quarter has a front longitudinal edge, wherein said anterior lateral portion defined on said front quarter comprises an inner lateral surface of said front quarter, and wherein said elongate element has an elongate element portion, said elongate element portion extending towards said rear quarter, said other end end being slideably associated with the inner lateral surface of said front quarter proximate to said front longitudinal edge.

12. Combination according to claim 1, wherein said means for adjusting said useful length of said elongate element are associated with said other end thereof, said means being constituted by;

cable takeup means, and at least one cable extending externally to said front quarter and being connected to said cable takeup means.

13. Combination according to claim 1, wherein said elongate element is constituted by at least one cable.

14. Combination according to claim 9, wherein said lateral surface defined on said shell is constituted by an inner lateral shell surface, and wherein said other end of said elongate element is rigidly associated with the inner lateral shell surface.

15. Combination according to claim 9, wherein said lateral surface defined on said shell is constituted by an inner lateral shell surface, and wherein said other end of said elongate element is slideably associated with the inner lateral shell surface.

16. In combination, a rear entry ski boot and a heel securing device, said ski boot comprising;

a shell, a front quarter associated with said shell, at least one anterior lateral portion defined on said front quarter, at least one opposite anterior lateral portion defined on said front quarter, a rear quarter articulated to said shell, at least one rear lateral portion defined on said rear quarter, and a heel region defined on said rear quarter, said heel securing device comprising;

at least one elongate element, said elongate element having at least one end and at least one other end, an intermediate portion defined by said elongate element, and a length dimension defined by said elongate element, said at least one end of said elongate element being at least temporarily connected to one lateral portion selected from among said one anterior lateral portion and said one rear lateral portion, said intermediate portion of said elongate element extending across said heel region of said rear quarter, said other end of said elongate element being at least temporarily connected to said opposite anterior lateral portion.

* * * * *